US012139995B2

(12) United States Patent
Coronado

(10) Patent No.: US 12,139,995 B2
(45) Date of Patent: Nov. 12, 2024

(54) HYBRID SLIP

(71) Applicant: The WellBoss Company, LLC, Houston, TX (US)

(72) Inventor: Martin P. Coronado, Fulshear, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 18/098,537

(22) Filed: Jan. 18, 2023

(65) Prior Publication Data

US 2023/0235640 A1 Jul. 27, 2023

Related U.S. Application Data

(60) Provisional application No. 63/303,167, filed on Jan. 26, 2022.

(51) Int. Cl.
*E21B 33/129* (2006.01)

(52) U.S. Cl.
CPC ..... *E21B 33/1293* (2013.01)

(58) Field of Classification Search
CPC ..... E21B 33/129; E21B 33/1293
See application file for complete search history.

(56) References Cited

U.S. PATENT DOCUMENTS

2013/0112412 A1* 5/2013 Frazier ..... E21B 29/002 166/217
2016/0047188 A1* 2/2016 Dirocco ..... E21B 33/129 166/217
2019/0249514 A1* 8/2019 Davies ..... E21B 33/1291

* cited by examiner

*Primary Examiner* — D. Andrews
*Assistant Examiner* — Ronald R Runyan
(74) *Attorney, Agent, or Firm* — Kearney, McWilliams & Davis, PLLC; John M. DeBoer

(57) ABSTRACT

A downhole tool having a mandrel and a slip. The mandrel has a mandrel body having a proximate end; a distal end; and an outer surface. The slip is a hybrid slip having a slip shell engaged with a slip core. When the slip shell is engaged with the slip core, at least one break point of the slip shell is aligned with a respective break point of the slip core.

17 Claims, 9 Drawing Sheets

PRIOR ART

200

HYBRID SLIP

STATEMENT REGARDING FEDERALLY SPONSORED RESEARCH OR DEVELOPMENT

Not applicable.

BACKGROUND

Field of the Disclosure

This disclosure generally relates to tools used in oil and gas wellbores. More specifically, the disclosure relates to downhole tools that may be run into a wellbore and useable for wellbore isolation, and systems and methods pertaining to the same. In particular embodiments, the tool may be a plug having at least one slip with a hybrid configuration.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs is typically has low permeability, and it is uneconomical to produce the hydrocarbons (i.e., gas, oil, etc.) in commercial quantities from this formation without the use of drilling accompanied with fracing operations.

Fracing is common in the industry and growing in popularity and general acceptance, and includes the use of a plug set in the wellbore below or beyond the respective target zone, followed by pumping or injecting high pressure frac fluid into the zone. The frac operation results in fractures or "cracks" in the formation that allow hydrocarbons to be more readily extracted and produced by an operator, and may be repeated as desired or necessary until all target zones are fractured.

A frac plug serves the purpose of isolating the target zone for the frac operation. Such a tool is usually constructed of durable metals, with a sealing element being a compressible material that may also expand radially outward to engage the tubular and seal off a section of the wellbore and thus allow an operator to control the passage or flow of fluids. For example, by forming a pressure seal in the wellbore and/or with the tubular, the frac plug allows pressurized fluids or solids to treat the target zone or isolated portion of the formation.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 105 (e.g., e-line, wireline, coiled tubing, etc.) and/or with setting tool 112, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations commence, the plugs must also be removed so that installation of production tubing may occur. This typically occurs by drilling through the set plug, but in some instances the plug can be removed from the wellbore essentially intact. A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Many plugs and other downhole tool use a metal (e.g., cast iron) slip in its construction. Cast iron material, for example, provides the required mechanical strength to withstand differential pressures up to 15,000 psi. Being cast iron, the external surface, which consists of multiple "teeth" profiles, is hard enough to penetrate into the casing when the plug is set to anchor it in position in the wellbore for the subsequent fracturing operation.

Once the fracturing operation is completed for all stages in the well, the frac plugs are drilled/milled out so an unobstructed wellbore is regained and production may begin. The cast iron construction allows for relatively easy drillout/millout compared to conventional steels. However, many operators have now become wary of the amount of cast iron that is left in the well after the drillout operation, which has impacted the attractiveness of this plug type.

The use of plugs in a wellbore is not without other problems, as these tools are subject to known failure modes. When the plug is run into position, the slips have a tendency to pre-set before the plug reaches its destination, resulting in damage to the casing and operational delays. Pre-set may result, for example, because of residue or debris (e.g., sand) left from a previous frac. In addition, conventional plugs are known to provide poor sealing, not only with the casing, but also between the plug's components. For example, when the sealing element is placed under compression, its surfaces do not always seal properly with surrounding components (e.g., cones, etc.).

Downhole tools are often activated with a drop ball that is flowed from the surface down to the tool, whereby the pressure of the fluid must be enough to overcome the static pressure and buoyant forces of the wellbore fluid(s) in order for the ball to reach the tool. Frac fluid is also highly pressurized in order to not only transport the fluid into and through the wellbore, but also extend into the formation in order to cause fracture. Accordingly, a downhole tool must be able to withstand these additional higher pressures.

There is a need in the art for a slip that provides the benefits of a metal slip, yet does not require a full metal body. There are needs in the art for novel systems and methods for isolating wellbores in a viable and economical fashion. There is a great need in the art for downhole plugging tools that form a reliable and resilient seal against a surrounding tubular. There is also a need for a downhole tool made substantially of a drillable material that is easier and faster to drill. It is highly desirous for these downhole tools to readily and easily withstand extreme wellbore conditions, and at the same time be cheaper, smaller, lighter, and useable in the presence of high pressures associated with drilling and completion operations.

SUMMARY

Embodiments of the disclosure pertain to a hybrid slip for a downhole tool. The downhole tool may include a mandrel having a mandrel body. The mandrel body may have a proximate end; a distal end; and an outer surface. There may be a hybrid slip disposed around the mandrel. The hybrid slip may include a slip shell, which may be a durable material such as plastic. The slip may have an outer shell surface and an inner shell surface.

The hybrid slip may have a first groove defined by a depth extending from the outer shell surface through the inner shell surface. The first groove may have a length oriented in a lateral. There may be a second groove defined by a second depth from the outer shell surface. The second groove need not go all the way through to the inner shell surface. There may be a third groove having a third groove length oriented in a longitudinal.

The hybrid slip may have a slip core disposed within or otherwise engaged with the slip shell. The slip core may include an outer core surface engaged with the inner shell surface. There may be a core groove having an opening coterminous to the first groove. The slip core may be made of a composite material. In aspects, the slip core may be epoxied to the slip shell. The mandrel may have a flowbore, and an inner surface along the flowbore. There may be set of threads formed on the inner surface.

The downhole tool may include a composite member disposed around the mandrel. The composite member may have a resilient portion and/or a deformable portion. The downhole tool may include a lower sleeve, a sealing element, and/or other components. In aspects, each of the slip shell and the slip core may have a one-piece configuration.

Yet other embodiments of the disclosure pertain to a downhole tool that may include a mandrel and a hybrid slip. The mandrel may include a mandrel body having a proximate end; a distal end; and an outer surface. The mandrel body may include a first outer diameter at the proximate end, a second outer diameter at the distal end, and an angled linear transition surface therebetween.

The hybrid slip may be disposed around the mandrel. The hybrid slip may include a slip shell having an outer shell surface and an inner shell surface. The slip shell may be metallic. There may be a first groove defined by a depth extending from the outer shell surface through the inner shell surface, and having a length oriented in a lateral. There may be a second groove defined by a second depth from the outer shell surface but does not go all the way through to the inner shell surface. There may be a third groove having a third groove length oriented in a longitudinal.

The hybrid slip may have a slip core disposed within or otherwise engaged with the shell. The slip core may include an outer core surface engaged with the inner shell surface. The slip core may have a core groove having an opening coterminous to the first groove. The slip core may be made of a non-metallic material, such as plastic or composite. The slip core may be adhered to the slip shell.

Still other embodiments herein pertain to a slip for use with a downhole tool. The slip may include a slip shell having: an outer shell surface; an inner shell surface; a first groove defined by a depth extending from the outer shell surface through the inner shell surface; and/or a second groove defined by a second depth from the outer shell surface but does not go all the way through to the inner shell surface. The first groove may have a groove length oriented in a lateral. There may be a slip core disposed within the shell. The slip core may include an outer core surface engaged with the inner shell surface.

These and other embodiments, features and advantages will be apparent in the following detailed description and drawings.

BRIEF DESCRIPTION OF THE DRAWINGS

For a more detailed description of the present invention, reference will now be made to the accompanying drawings, wherein.

DETAILED DESCRIPTION

Figure 1:
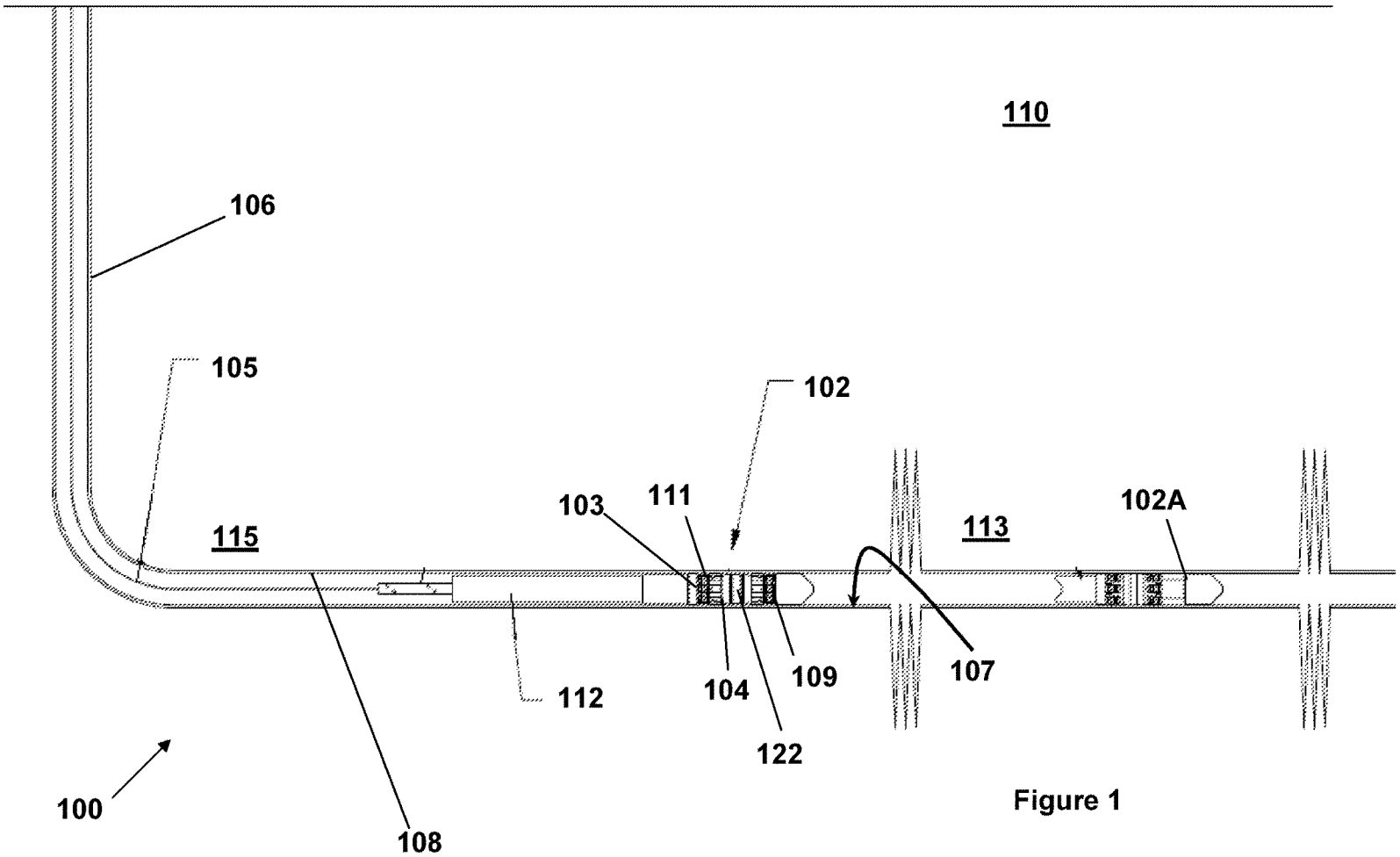
FIG. 1 is a side view of a process diagram of a conventional plugging system.

Herein disclosed are novel apparatuses, systems, and methods that pertain to downhole tools usable for wellbore operations, details of which are described herein.

Downhole tools according to embodiments disclosed herein may include one or more anchor slips, one or more compression cones engageable with the slips, and a compressible seal element disposed therebetween, all of which may be configured or disposed around a mandrel. The mandrel may include a flow bore open to an end of the tool and extending to an opposite end of the tool. In embodiments, the downhole tool may be a frac plug or a bridge plug. Thus, the downhole tool may be suitable for frac operations. In an exemplary embodiment, the downhole tool may be a composite frac plug made of drillable material, the plug being suitable for use in vertical or horizontal wellbores.

The downhole tool may include a first slip disposed about the mandrel and configured for engagement with the composite member. In an embodiment, the first slip may engage the angled surface of the resilient portion of an adjacent member. The downhole tool may further include a cone piece disposed about the mandrel. The cone piece may include a first end and a second end, wherein the first end may be configured for engagement with a seal element. The downhole tool may also include a second slip, which may be configured for contact with the cone. In an embodiment, the second slip may be moved into engagement or compression with the second end of the cone during setting. In another embodiment, the second slip may have a one-piece configuration with at least one groove or undulation disposed therein.

In accordance with embodiments of the disclosure, setting of the downhole tool in the wellbore may include the first slip and the second slip in gripping engagement with a surrounding tubular, the seal element sealingly engaged with the surrounding tubular, and/or application of a load to the mandrel sufficient enough to shear one of the sets of the threads.

Any of the slips may be composite material or metal (e.g., cast iron). Any of the slips may include gripping elements, such as inserts, buttons, teeth, serrations, etc., configured to provide gripping engagement of the tool with a surrounding surface, such as the tubular. In an embodiment, the second slip may include a plurality of inserts disposed therearound.

The downhole tool (or tool components) may include a longitudinal axis, including a central long axis. The mandrel may have a distal end and a proximate end. There may be a bore formed therebetween. In an embodiment, one of the sets of threads on the mandrel may be shear threads. In other embodiments, one of the sets of threads may be shear threads disposed along a surface of the bore at the proximate end. In yet other embodiments, one of the sets of threads may be rounded threads. For example, one of the sets of threads may be rounded threads that are disposed along an external mandrel surface, such as at the distal end. The round threads may be used for assembly and setting load retention.

The mandrel may be coupled with a setting adapter configured with corresponding threads that mate with the first set of threads. In an embodiment, the adapter may be configured for fluid to flow therethrough. The mandrel may also be coupled with a sleeve configured with corresponding threads that mate with threads on the end of the mandrel. In an embodiment, the sleeve may mate with the second set of threads. In other embodiments, setting of the tool may result in distribution of load forces along the second set of threads at an angle that is directed away from an axis.

Although not limited, the downhole tool or any components thereof may be made of a composite material. In an embodiment, the mandrel, the cone, and the first material each consist of filament wound drillable material.

In embodiments, an e-line or wireline mechanism may be used in conjunction with deploying and/or setting the tool. There may be a pre-determined pressure setting, where upon excess pressure produces a tensile load on the mandrel that results in a corresponding compressive force indirectly between the mandrel and a setting sleeve. The use of the stationary setting sleeve may result in one or more slips being moved into contact or secure grip with the surrounding tubular, such as a casing string, and also a compression (and/or inward collapse) of the seal element. The axial compression of the seal element may be (but not necessarily) essentially simultaneous to its radial expansion outward and into sealing engagement with the surrounding tubular. To disengage the tool from the setting mechanism (or wireline adapter), sufficient tensile force may be applied to the mandrel to cause mated threads therewith to shear.

When the tool is drilled out, the lower sleeve engaged with the mandrel (secured in position by an anchor pin, shear pin, etc.) may aid in prevention of tool spinning. As drill-through of the tool proceeds, the pin may be destroyed or fall, and the lower sleeve may release from the mandrel and may fall further into the wellbore and/or into engagement with another downhole tool, aiding in lockdown with the subsequent tool during its drill-through. Drill-through may continue until the downhole tool is removed from engagement with the surrounding tubular.

Figure 2A:
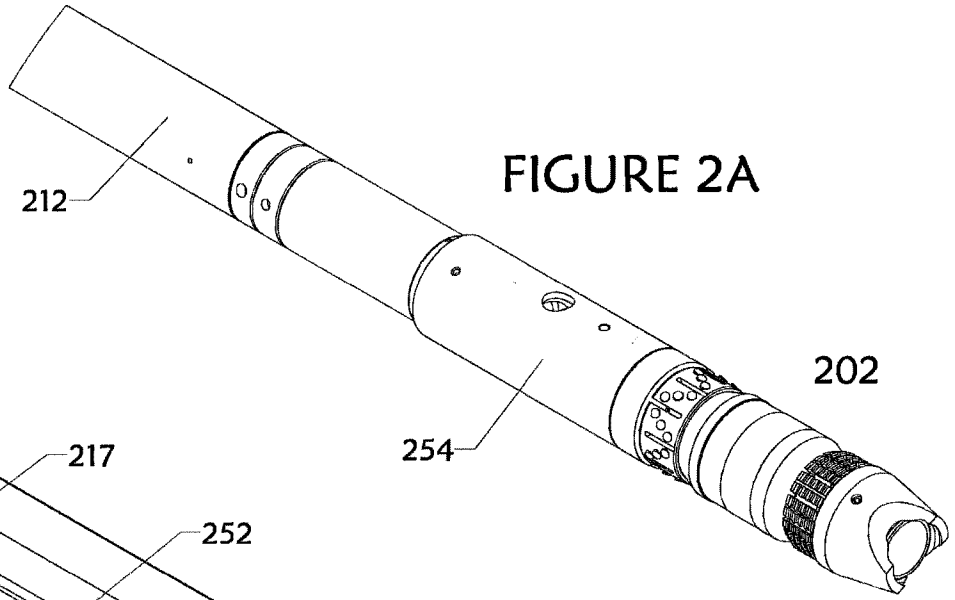
FIG. 2A shows an isometric view of a system having a downhole tool, according to embodiments of the disclosure.
Figure 2B:
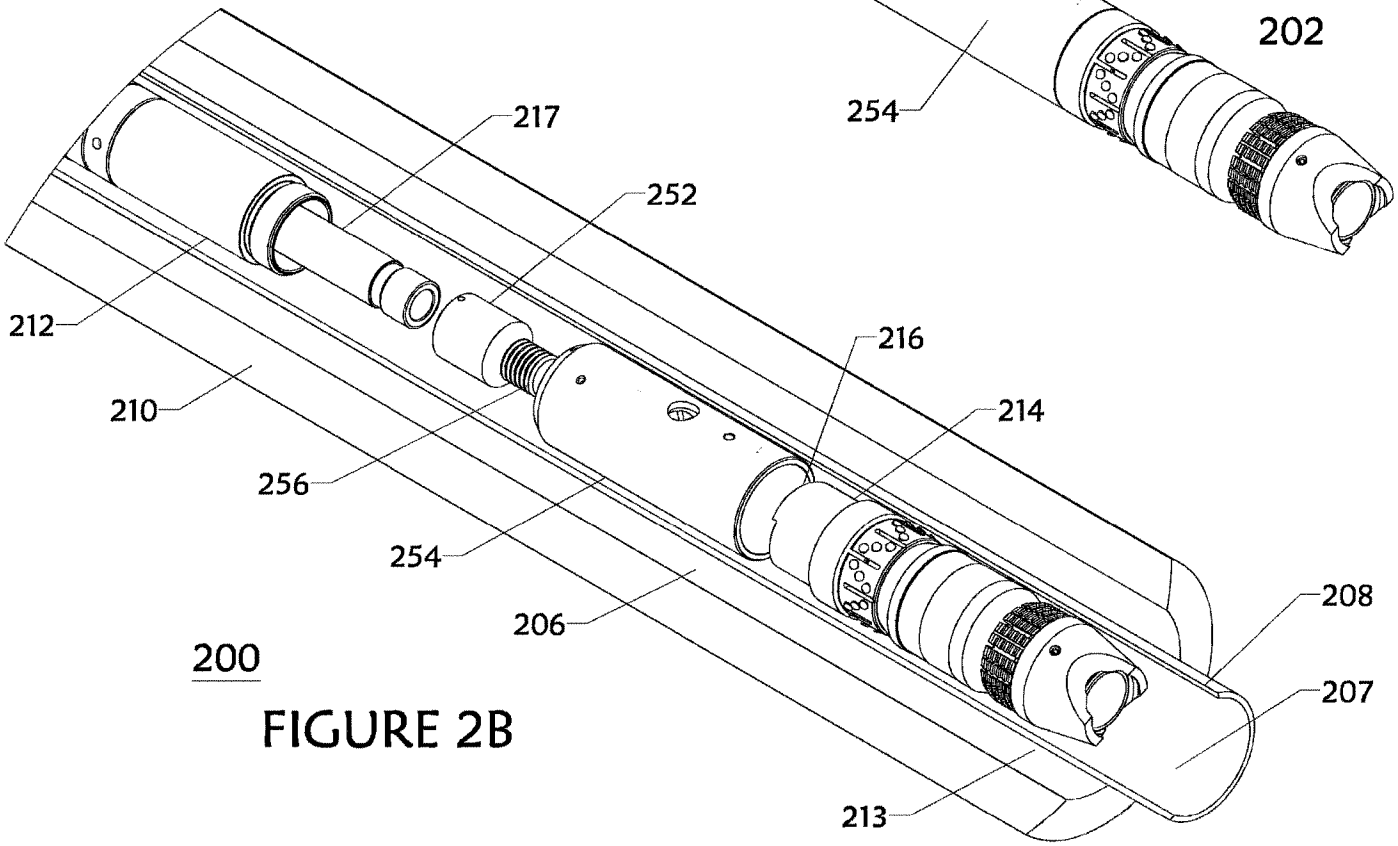
FIG. 2B shows an isometric view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (which may include a part 217 of a setting tool (such as tension mandrel 217*a* [FIG. 2D]) coupled with adapter 252) may be used to position or run the downhole tool 202 into and through the wellbore 206 to a desired location.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section of the wellbore 213 to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of the mandrel 214. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations.

Once the tool 202 reaches the set position within the tubular, the setting mechanism or workstring 212 may be detached from the tool 202 by various methods, resulting in the tool 202 left in the surrounding tubular and one or more sections of the wellbore isolated. In an embodiment, once the tool 202 is set, tension may be applied to the adapter 252 until the threaded connection between the adapter 252 and the mandrel 214 is broken. For example, the mating threads on the adapter 252 and the mandrel 214 (256 and 216, respectively as shown in FIG. 2D) may be designed to shear, and thus may be pulled and sheared accordingly in a manner known in the art. The amount of load applied to the adapter 252 may be in the range of about, for example, 20,000 to 40,000 pounds force. In other applications, the load may be in the range of less than about 10,000 pounds force.

Accordingly, the adapter 252 may separate or detach from the mandrel 214, resulting in the workstring 212 being able to separate from the tool 202, which may be at a predetermined moment. The loads provided herein are non-limiting and are merely exemplary. The setting force may be determined by specifically designing the interacting surfaces of the tool and the respective tool surface angles. The tool may 202 also be configured with a predetermined failure point (not shown) configured to fail or break. For example, the failure point may break at a predetermined axial force greater than the force required to set the tool but less than the force required to part the body of the tool.

Operation of the downhole tool 202 may allow for fast run in of the tool 202 to isolate one or more sections of the wellbore 206, as well as quick and simple drill-through to destroy or remove the tool 202. Drill-through of the tool 202 may be facilitated by components and sub-components of tool 202 made of drillable material that is less damaging to a drill bit than those found in conventional plugs. In an embodiment, the downhole tool 202 and/or its components may be a drillable tool made from drillable composite material(s), such as glass fiber/epoxy, carbon fiber/epoxy, glass fiber/PEEK, carbon fiber/PEEK, etc. Other resins may include phenolic, polyamide, etc. All mating surfaces of the downhole tool 202 may be configured with an angle, such that corresponding components may be placed under compression instead of shear.

Figure 2C:
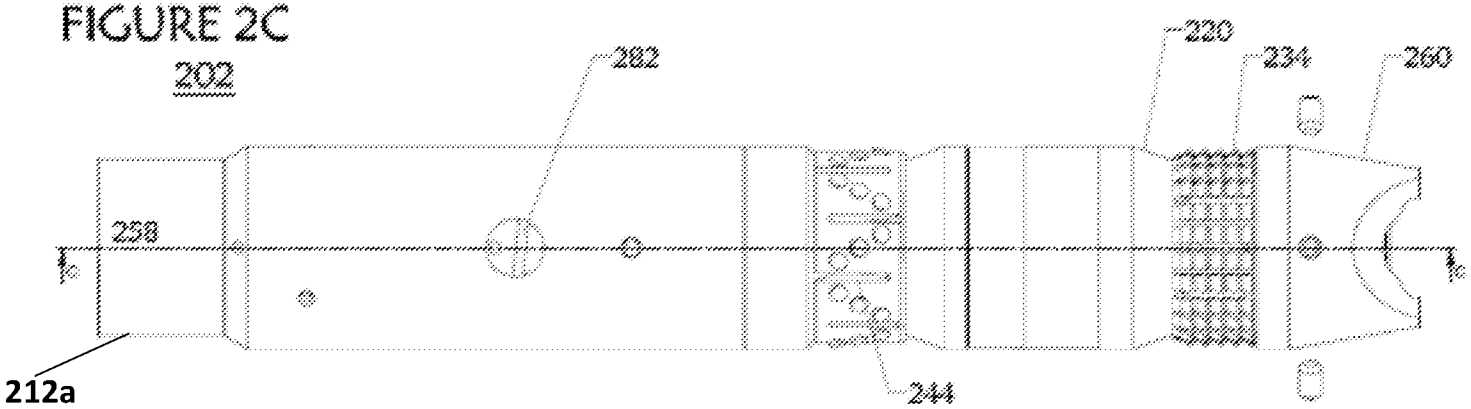
FIG. 2C shows a side longitudinal view of a downhole tool according to embodiments of the disclosure.
Figure 2D:
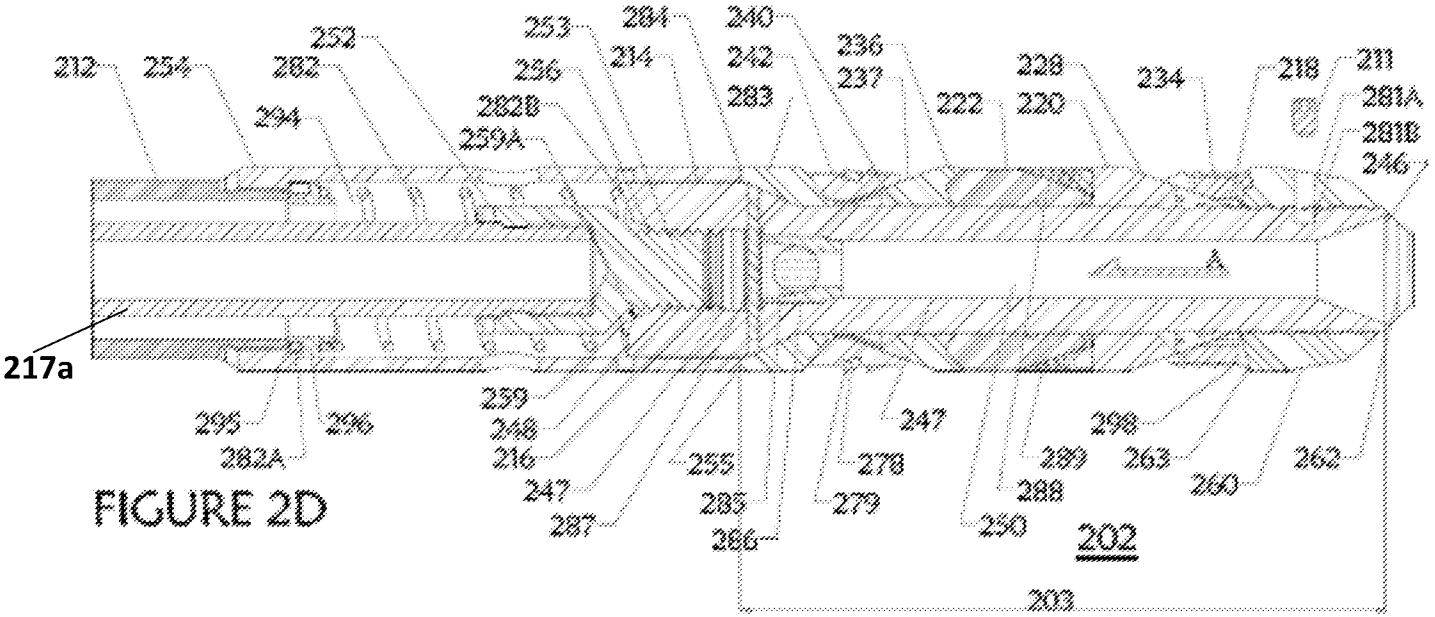
FIG. 2D shows a longitudinal cross-sectional view of a downhole tool according to embodiments of the disclosure.
Figure 2E:
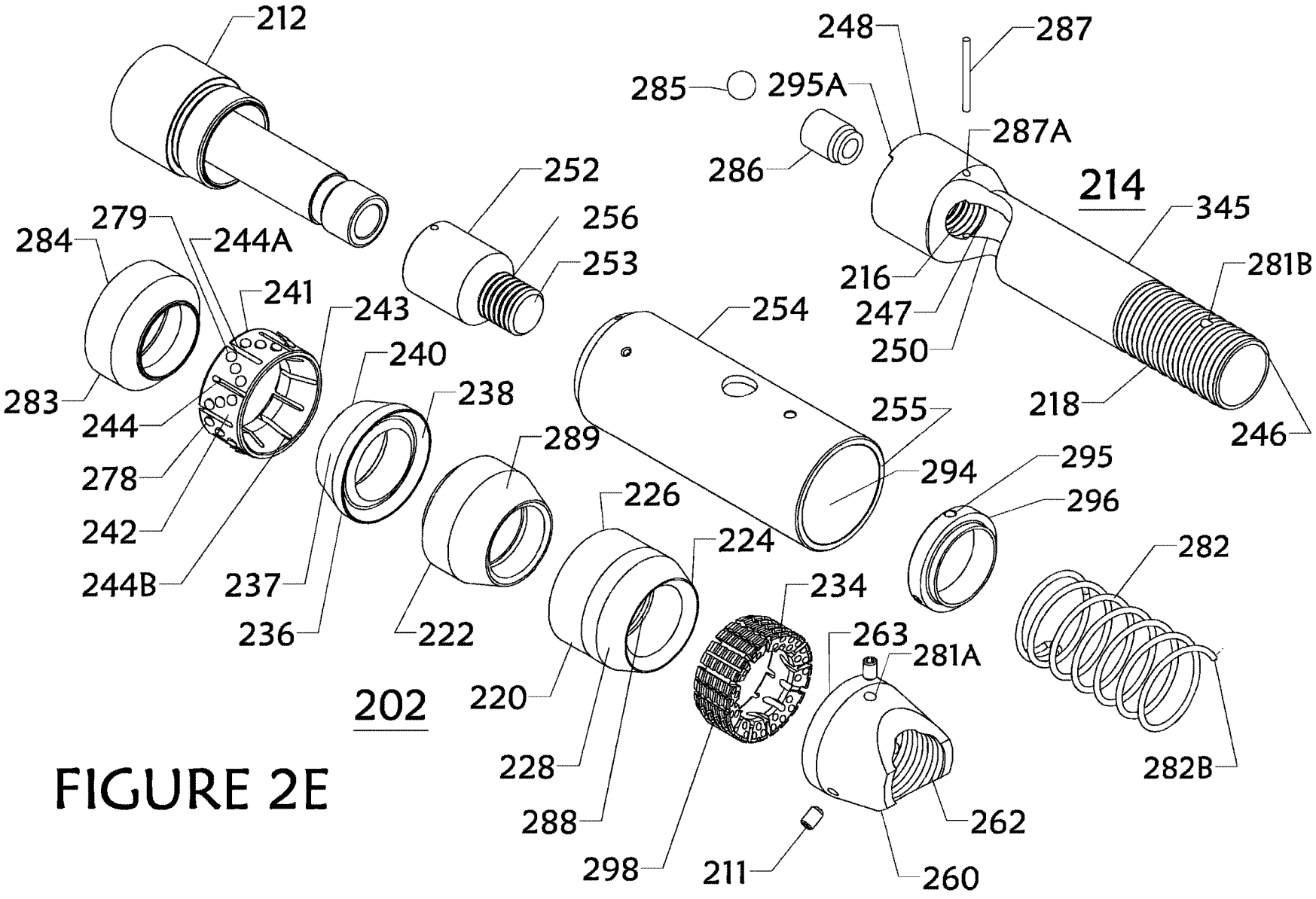
FIG. 2E shows an isometric component break-out view of a downhole tool according to embodiments of the disclosure.

Referring now to FIGS. 2C-2E together, a longitudinal view, a longitudinal cross-sectional view, and an isometric component break-out view, respectively, of downhole tool 202 useable with system (200, FIG. 2A) and illustrative of embodiments disclosed herein, are shown. The downhole tool 202 may include a mandrel 214 that extends through the tool (or tool body) 202. The mandrel 214 may be a solid body. In other aspects, the mandrel 214 may include a flowpath or bore 250 formed therein (e.g., an axial bore). The bore 250 may extend partially or for a short distance through the mandrel 214, as shown in FIG. 2E. Alternatively, the bore 250 may extend through the entire mandrel 214, with an opening at its proximate end 248 and oppositely at its distal end 246 (near downhole end of the tool 202), as illustrated by FIG. 2D.

The presence of the bore 250 or other flowpath through the mandrel 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk can pass or flow through the bore 250 without plugging concerns. However, with the use of a smaller diameter tool 202, the size of the bore 250 may need to be correspondingly smaller, which may result in the tool 202 being prone to plugging. Accordingly, the mandrel may be made solid to alleviate the potential of plugging within the tool 202.

With the presence of the bore 250, the mandrel 214 may have an inner bore surface 247, which may include one or more threaded surfaces formed thereon. As such, there may be a first set of threads 216 configured for coupling the mandrel 214 with corresponding threads 256 of a setting adapter 252.

The coupling of the threads, which may be shear threads, may facilitate detachable connection of the tool 202 and the setting adapter 252 and/or workstring (212, FIG. 2B) at the threads. It is within the scope of the disclosure that the tool 202 may also have one or more predetermined failure points (not shown) configured to fail or break separately from any threaded connection. The failure point may fail or shear at a predetermined axial force greater than the force required to set the tool 202.

The adapter 252 may include a stud 253 configured with the threads 256 thereon. In an embodiment, the stud 253 has external (male) threads 256 and the mandrel 214 has internal (female) threads; however, type or configuration of threads is not meant to be limited, and could be, for example, a vice versa female-male connection, respectively.

The downhole tool 202 may be run into wellbore (206, FIG. 2A) to a desired depth or position by way of the workstring (212, FIG. 2A) that may be configured with the setting device or mechanism. The workstring 212 and setting sleeve 254 may be part of the plugging tool system 200 utilized to run the downhole tool 202 into the wellbore, and activate the tool 202 to move from an unset to set position. The set position may include seal element 222 and/or slips 234, 242 engaged with the tubular (208, FIG. 2B). In an embodiment, the setting sleeve 254 (that may be configured as part of the setting mechanism or workstring) may be utilized to force or urge compression of the seal element 222, as well as swelling of the seal element 222 into sealing engagement with the surrounding tubular.

The setting device(s) and components of the downhole tool 202 may be coupled with, and axially and/or longitudinally movable along mandrel 214. The setting tool (217, FIG. 2B) may include a setting tool (upper housing) 212*a* coupled with the setting sleeve 254. The setting tool may include a tension mandrel 217*a*. The tension mandrel 217*a* may be coupled with the mandrel 214. The adapter 252 may be coupled between the tension mandrel 217*a* and the mandrel 214. The adapter 252 may be threadingly engaged with the tension mandrel 217*a*, and/or the adapter 252 may be thradingly engaged with the mandrel 214.

When the setting sequence begins, the mandrel 214 may be pulled into tension while the setting sleeve 254 remains stationary. The lower sleeve 260 may be pulled as well because of its attachment to the mandrel 214 by virtue of the coupling of threads 218 and threads 262. As shown in the embodiment of FIGS. 2C and 2D, the lower sleeve 260 and the mandrel 214 may have matched or aligned holes 281A and 281B, respectively, whereby one or more anchor pins 211 or the like may be disposed or securely positioned therein. In embodiments, brass set screws may be used. Pins (or screws, etc.) 211 may prevent shearing or spin-off during drilling or run-in.

As the lower sleeve 260 is pulled in the direction of Arrow A, the components disposed about mandrel 214 between the lower sleeve 260 and the setting sleeve 254 may begin to compress against one another. This force and resultant movement causes compression and expansion of seal element 222. The lower sleeve 260 may also have an angled sleeve end 263 in engagement with the slip 234, and as the lower sleeve 260 is pulled further in the direction of Arrow A, the end 263 compresses against the slip 234. As a result, slip(s) 234 may move along a tapered or angled surface 228 of a composite member 220, and eventually radially outward into engagement with the surrounding tubular (208, FIG. 2B).

Serrated outer surfaces or teeth 298 of the slip(s) 234 may be configured such that the surfaces 298 prevent the slip 234 (or tool) from moving (e.g., axially or longitudinally) within the surrounding tubular, whereas otherwise the tool 202 may inadvertently release or move from its position. Although slip 234 is illustrated with teeth 298, it is within the scope of the disclosure that slip 234 may be configured with other gripping features, such as buttons or inserts.

Initially, the seal element 222 may swell into contact with the tubular, followed by further tension in the tool 202 that may result in the seal element 222 and composite member 220 being compressed together, such that surface 289 acts on the interior surface 288. The ability to "flower", unwind, and/or expand may allow the composite member 220 to extend completely into engagement with the inner surface of the surrounding tubular.

Additional tension or load may be applied to the tool 202 that results in movement of cone 236, which may be disposed around the mandrel 214 in a manner with at least one surface 237 angled (or sloped, tapered, etc.) inwardly of second slip 242. The second slip 242 may reside adjacent or proximate to collar or cone 236. As such, the seal element 222 forces the cone 236 against the slip 242, moving the slip 242 radially outwardly into contact or gripping engagement with the tubular. Accordingly, the one or more slips 234, 242 may be urged radially outward and into engagement with the tubular (208, FIG. 2B). In an embodiment, cone 236 may be slidingly engaged and disposed around the mandrel 214. As shown, the first slip 234 may be at or near distal end 246, and the second slip 242 may be disposed around the mandrel 214 at or near the proximate end 248. It is within the scope of the disclosure that the position of the slips 234 and 242 may be interchanged. Moreover, slip 234 may be interchanged with a slip comparable to slip 242, and vice versa.

Because the sleeve 254 is held rigidly in place, the sleeve 254 may engage against a bearing plate 283 that may result in the transfer load through the rest of the tool 202. The setting sleeve 254 may have a sleeve end 255 that abuts against the bearing plate end 284. As tension increases through the tool 202, an end of the cone 236, such as second end 240, compresses against slip 242, which may be held in place by the bearing plate 283. As a result of cone 236 having freedom of movement and its conical surface 237, the cone 236 may move to the underside beneath the slip 242, forcing the slip 242 outward and into engagement with the surrounding tubular (208, FIG. 2B).

The second slip 242 may include one or more, gripping elements, such as buttons or inserts 278, which may be configured to provide additional grip with the tubular. The inserts 278 may have an edge or corner 279 suitable to provide additional bite into the tubular surface. In an embodiment, the inserts 278 may be mild steel, such as 1018 heat treated steel. The use of mild steel may result in reduced or eliminated casing damage from slip engagement and reduced drill string and equipment damage from abrasion.

In an embodiment, slip 242 may be a one-piece slip, whereby the slip 242 has at least partial connectivity across its entire circumference. Meaning, while the slip 242 itself may have one or more grooves (or undulation, notch, etc.) 244 configured therein, the slip 242 itself has no initial circumferential separation point. In an embodiment, the grooves 244 may be equidistantly spaced or disposed in the second slip 242. In other embodiments, the grooves 244 may have an alternatingly arranged configuration. That is, one groove 244A may be proximate to slip end 241, the next groove 244B may be proximate to an opposite slip end 243, and so forth.

The tool 202 may be configured with ball plug check valve assembly that includes a ball seat 286. The assembly may be removable or integrally formed therein. In an embodiment, the bore 250 of the mandrel 214 may be configured with the ball seat 286 formed or removably disposed therein. In some embodiments, the ball seat 286 may be integrally formed within the bore 250 of the mandrel 214. In other embodiments, the ball seat 286 may be separately or optionally installed within the mandrel 214, as may be desired.

The ball seat 286 may be configured in a manner so that a ball 285 seats or rests therein, whereby the flowpath through the mandrel 214 may be closed off (e.g., flow through the bore 250 is restricted or controlled by the presence of the ball 285). For example, fluid flow from one direction may urge and hold the ball 285 against the seat 286, whereas fluid flow from the opposite direction may urge the ball 285 off or away from the seat 286. As such, the ball 285 and the check valve assembly may be used to prevent or otherwise control fluid flow through the tool 202. The ball 285 may be conventionally made of a composite material, phenolic resin, etc., whereby the ball 285 may be capable of holding maximum pressures experienced during downhole operations (e.g., fracing). By utilization of retainer pin 287, the ball 285 and ball seat 286 may be configured as a retained ball plug. As such, the ball 285 may be adapted to serve as a check valve by sealing pressure from one direction, but allowing fluids to pass in the opposite direction.

The tool 202 may be configured as a drop ball plug, such that a drop ball may be flowed to a drop ball seat 259. The drop ball may be much larger diameter than the ball of the ball check. In an embodiment, end 248 may be configured with a drop ball seat surface 259 such that the drop ball may come to rest and seat at in the seat proximate end 248. As applicable, the drop ball (not shown here) may be lowered into the wellbore (206, FIG. 2A) and flowed toward the drop ball seat 259 formed within the tool 202. The ball seat may be formed with a radius 259A (i.e., circumferential rounded edge or surface).

In other aspects, the tool 202 may be configured as a bridge plug, which once set in the wellbore, may prevent or allow flow in either direction (e.g., upwardly/downwardly, etc.) through tool 202. Accordingly, it should be apparent to one of skill in the art that the tool 202 of the present disclosure may be configurable as a frac plug, a drop ball plug, bridge plug, etc. simply by utilizing one of a plurality of adapters or other optional components. In any configuration, once the tool 202 is properly set, fluid pressure may be increased in the wellbore, such that further downhole operations, such as fracture in a target zone, may commence.

The tool 202 may include an anti-rotation assembly that includes an anti-rotation device or mechanism 282, which may be a spring, a mechanically spring-energized composite tubular member, and so forth. The device 282 may be configured and usable for the prevention of undesired or inadvertent movement or unwinding of the tool 202 components. As shown, the device 282 may reside in cavity 294 of the sleeve (or housing) 254. During assembly the device 282 may be held in place with the use of a lock ring 296. In other aspects, pins may be used to hold the device 282 in place.

FIG. 2D shows the lock ring 296 may be disposed around a part 217 of a setting tool coupled with the workstring 212. The lock ring 296 may be securely held in place with screws inserted through the sleeve 254. The lock ring 296 may include a guide hole or groove 295, whereby an end 282A of the device 282 may slidingly engage therewith. Protrusions or dogs 295A may be configured such that during assembly, the mandrel 214 and respective tool components may ratchet and rotate in one direction against the device 282; however, the engagement of the protrusions 295A with device end 282B may prevent back-up or loosening in the opposite direction.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device 282 and lock ring 296 may aid in keeping the rest of the tool together. As such, the device 282 may prevent tool components from loosening and/or unscrewing, as well as prevent tool 202 unscrewing or falling off the workstring 212.

Drill-through of the tool 202 may be facilitated by the fact that the mandrel 214, the slips 234, 242, the cone(s) 236, the composite member 220, etc. may be made of drillable material that is less damaging to a drill bit than those found in conventional plugs. The drill bit will continue to move through the tool 202 until the downhole slip 234 and/or 242 are drilled sufficiently that such slip loses its engagement with the well bore. When that occurs, the remainder of the tools, which generally would include lower sleeve 260 and any portion of mandrel 214 within the lower sleeve 260 falls into the well. If additional tool(s) 202 exist in the well bore beneath the tool 202 that is being drilled through, then the falling away portion will rest atop the tool 202 located further in the well bore and will be drilled through in connection with the drill through operations related to the tool 202 located further in the well bore. Accordingly, the tool 202 may be sufficiently removed, which may result in opening the tubular 208.

Slips. Referring now to FIGS. 3A, 3B, 3C, 3D, and 3E together, an underside isometric view of a hybrid slip, a longitudinal cross-sectional view the hybrid slip, an underside isometric view of a slip shell, an underside isometric view of a slip core, and a topside view of the hybrid slip, respectively, usable with a downhole tool in accordance with embodiments disclosed herein are shown.

The slip 334 described may be may be made from metal, such as cast iron, from composite material, such as filament wound composite, or other suitable materials. In embodiments, the slip 334 may be a poly-moldable material. In other embodiments, the slip 334 may be hardened, surface hardened, heat-treated, carburized, etc., as would be apparent to one of ordinary skill in the art.

The slip 334 may be used in either upper (top) or lower (bottom) slip position, or both, without limitation. As apparent, there may be a first slip 334, which may be disposed around the mandrel (214, FIG. 2C), and there may also be a second slip (342), which may also be disposed around the mandrel. Either of slips may include a means for gripping the inner wall of the tubular, casing, and/or well bore, such as a plurality of gripping elements, including serrations or teeth 398, inserts, etc. As shown here, the first slip 334 may include rows and/or columns 399 of serrations 398. The gripping elements may be arranged or configured whereby the slip 334 engages the tubular (not shown) in such a manner that movement (e.g., longitudinally axially) of the slips or the tool once set is prevented.

During heat treatment, the teeth 398 on the slip 334 may heat up and harden resulting in heat-treated outer area/teeth, but not the rest of the slip. In this manner, with treatments such as flame (surface) hardening, the contact point of the flame is minimized (limited) to the proximate vicinity of the teeth 398.

The slip 334 may be configured to include one or more holes or grooves 393 formed therein. The holes or grooves 393 may promote breakage or flaring. The slip 334 may also have one or more slots 392 formed between the columns 399. The slots 392 may be longitudinal in nature on an outer surface 315 of the slip 334. The slots 392 in the slip 334 may promote breakage. An evenly spaced configuration of slots 392 may promote even breakage of the slip 334. The holes 393 and slots 392 may also facilitate reduced metal material.

The first slip 334 may be disposed around or coupled to the mandrel (214, FIG. 2B) as would be known to one of skill in the art, such as a band or with shear screws (not shown) configured to maintain the position of the slip 334 until sufficient pressure (e.g., shear) is applied. The band may be made of steel wire, plastic material or composite material having the requisite characteristics in sufficient strength to hold the slip 334 in place while running the downhole tool into the wellbore, and prior to initiating setting. The band may be drillable.

When sufficient load is applied, the slip 334 may compress against the resilient portion or surface of an adjacent member (e.g., 220, FIG. 2C), and subsequently expand radially outwardly to engage the surrounding tubular (see, for example, slip 234 and composite member 220 in FIG. 2C).

Although not shown in detail here, the metal slip 334 may be a single body piece (e.g., see 234, FIG. 2E). In other embodiments, the slip 334 may be a hybrid slip, and thus, may have a slip shell 377 and a slip core 376. The slip 334 hybrid configuration shown here may have a material (metal) reduction geometry in order to reduce the volume of metal material in the slip 334.

Care and attention is needed as the reduction in metal may be problematic if it leads to a reduction in slip mechanical strength requirements. The slip 334 may be configured to retain the positive features of a full body metal slip, such as being able to case-harden the external surface, but may have dramatically reduced metal material volume of the slip. This may be achieved by adopting a dual-material construction, e.g., cast iron and composite material. In embodiments, the slip shell 377 may be metal, and the slip core 376 may be composite. The slip core 376 may be made of other materials, such as any type of high compression strength material.

In operation it may be the case that the slip core 376 is only subjected to compressive force due to the lower end of the slip shell 377 that retains the composite. This may reduce or eliminate any shearing forces being exerted on the core 376 that may ordinarily cause delamination. The slip shell 377 may be webbed in construction, which may facilitate anti-preset, but also breakage (i.e., the shell 377 may still break into segments when compression loaded during the setting process). The slip core 376 may be similarly webbed to break as the slip shell 377 breaks, but at a much lower force requirement.

The slip shell 377 may be one-piece in nature, configuration defined by at least partial connectivity of slip material around the entirety of its shell body, as shown via connectivity reference line 374. The shell 377 may have a first shell end 325*a* and a second shell end 325*b*. In an analogous manner the shell 377 may have a first or outer shell surface 315 and a second or inner shell surface 309. Other than the presence of various holes 393 (393*a*, 393*b*, etc.), the inner shell surface 309 may be contemplated as smooth and continuous. In contrast, the outer shell surface 315 may be discontinuous via the presence of one or more columns 399 of teeth 398.

The shell 377 may have one or more axial grooves 393. There may be an axial groove 393*a* and/or 393*b*, whereby the long axis of the respective groove is parallel a long axis 397. The grooves 393*a*, 393*b* may be of varied shape. For example, the groove 393*a* may have a depth (or analogously, length) d2

The outer geometry of the hybrid slip 334 may be comparable to existing slip (teeth area). The lower surface that abuts the lower sub is also relatively identical. The "hollowed out" shell 377 promotes reduction of the amount of hard material (e.g., cast iron) facilitates replacement with another high-strength material which can be easily drilled out, such as composite. The bulk of the existing Boss Hog plug is made from composite material.

The shell 377 and the core 376 may be coupled together, such as press-fit, tolerance fit, adherence (such as epoxied) or the like. Break points between the shell 377 and the core 376 may be kept in alignment. When engaged together, a top (underside) shell surface 323*b* may come into contact with an outer surface 380 of the core 376 at contact point 319*b*. The outer surface 380 may have a top or shoulder surface 380*a* engaged with the shell surface 323*b*. The outer surface 380 may also come into contact with a side shell surface 323*c*, such as seen at contact point 319*a*.

A top (topside) shell surface 323 may have one or more of the grooves 393 disposed therein. The grooves on the shell surface 323 may have one or more varied configurations. For example, one of the grooves may have a depth or width d5 that extends the entire length of the topside shell surface 323. That groove or another groove 393*c* may have a depth extending into the surface 323, but not entirely therethrough. For example, the groove may have a (partial) depth d3. That groove or another groove 393*d* may have a respective depth d1 extending all the way through from the shell surface 323 to the underside shell surface 323*a*. The longest dimension (length) of another groove 393*d* may be oriented in a lateral 396.

Figure 3A:
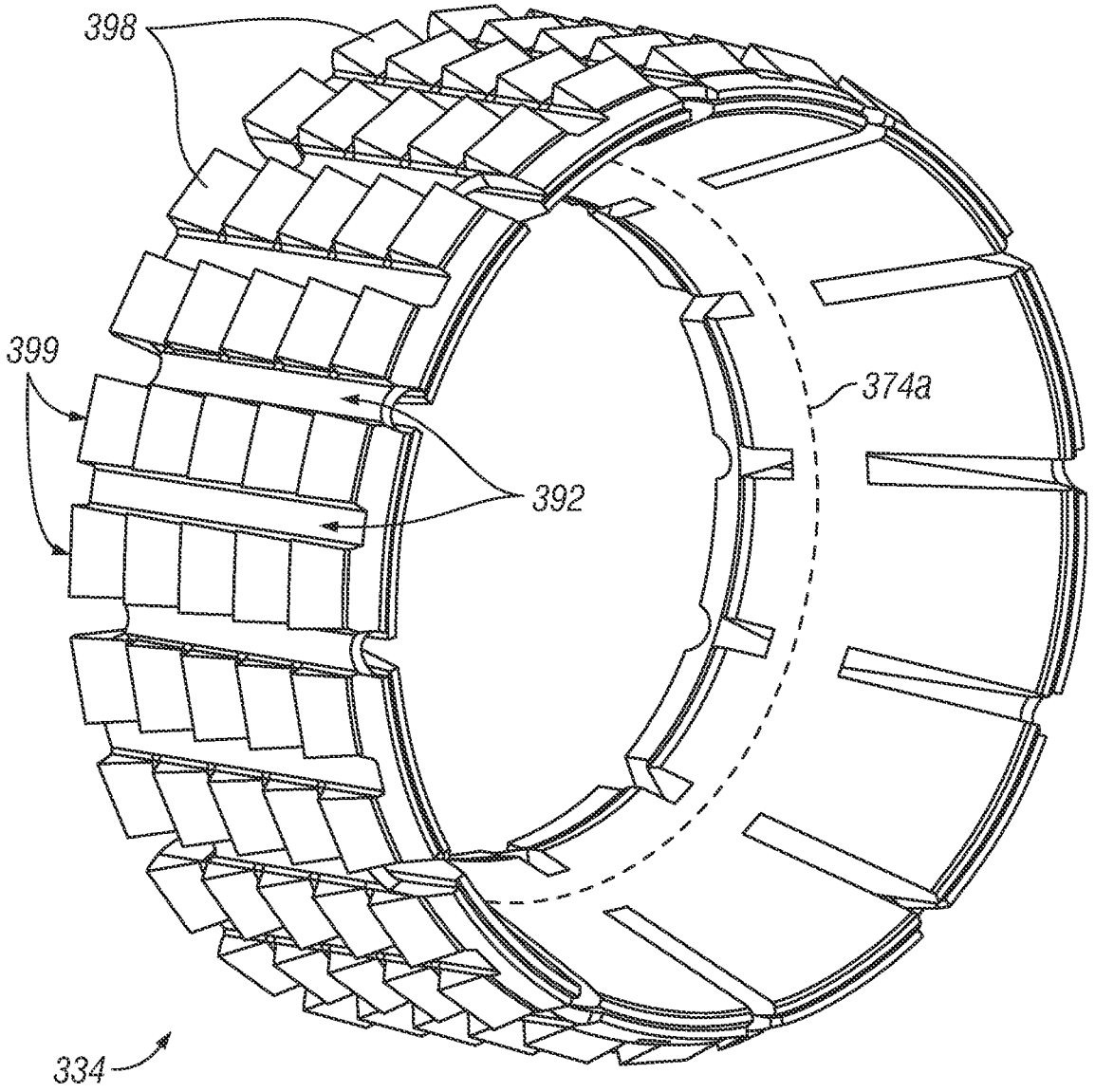
FIG. 3A shows an underside isometric view of a hybrid slip according to embodiments of the disclosure.
Figure 3B:
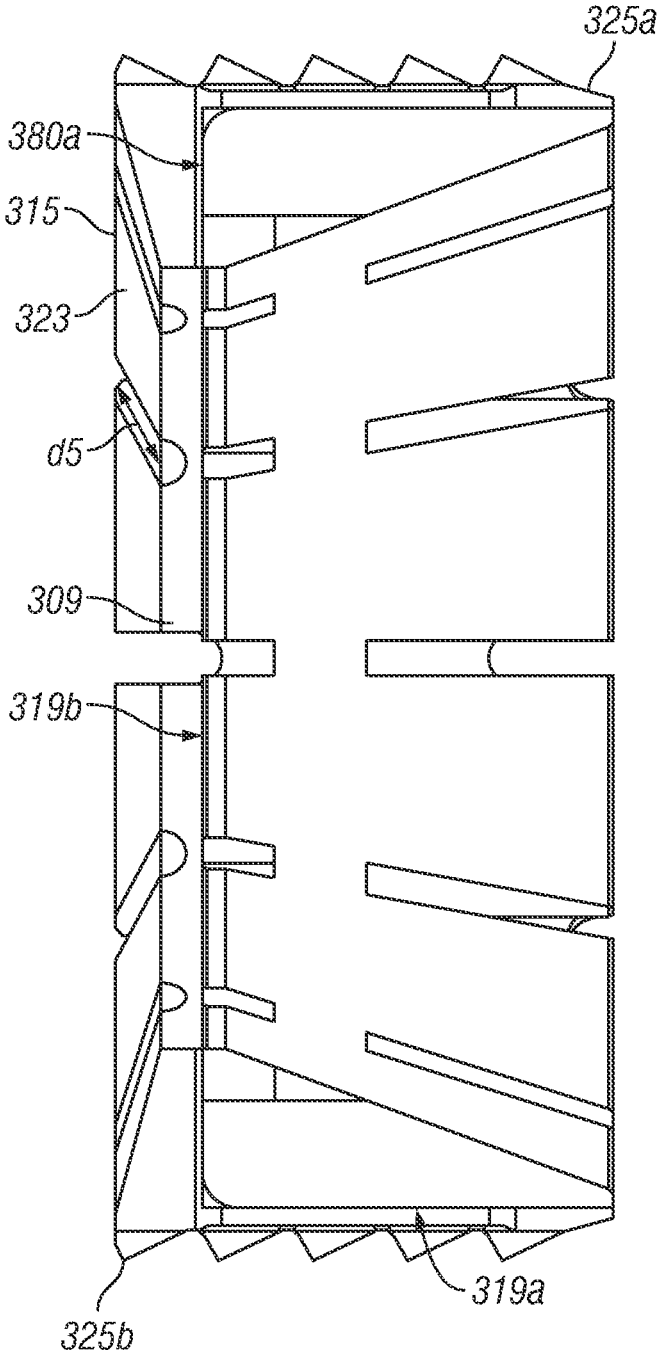
FIG. 3B shows a longitudinal cross-sectional view the hybrid slip according to embodiments of the disclosure.
Figure 3C:
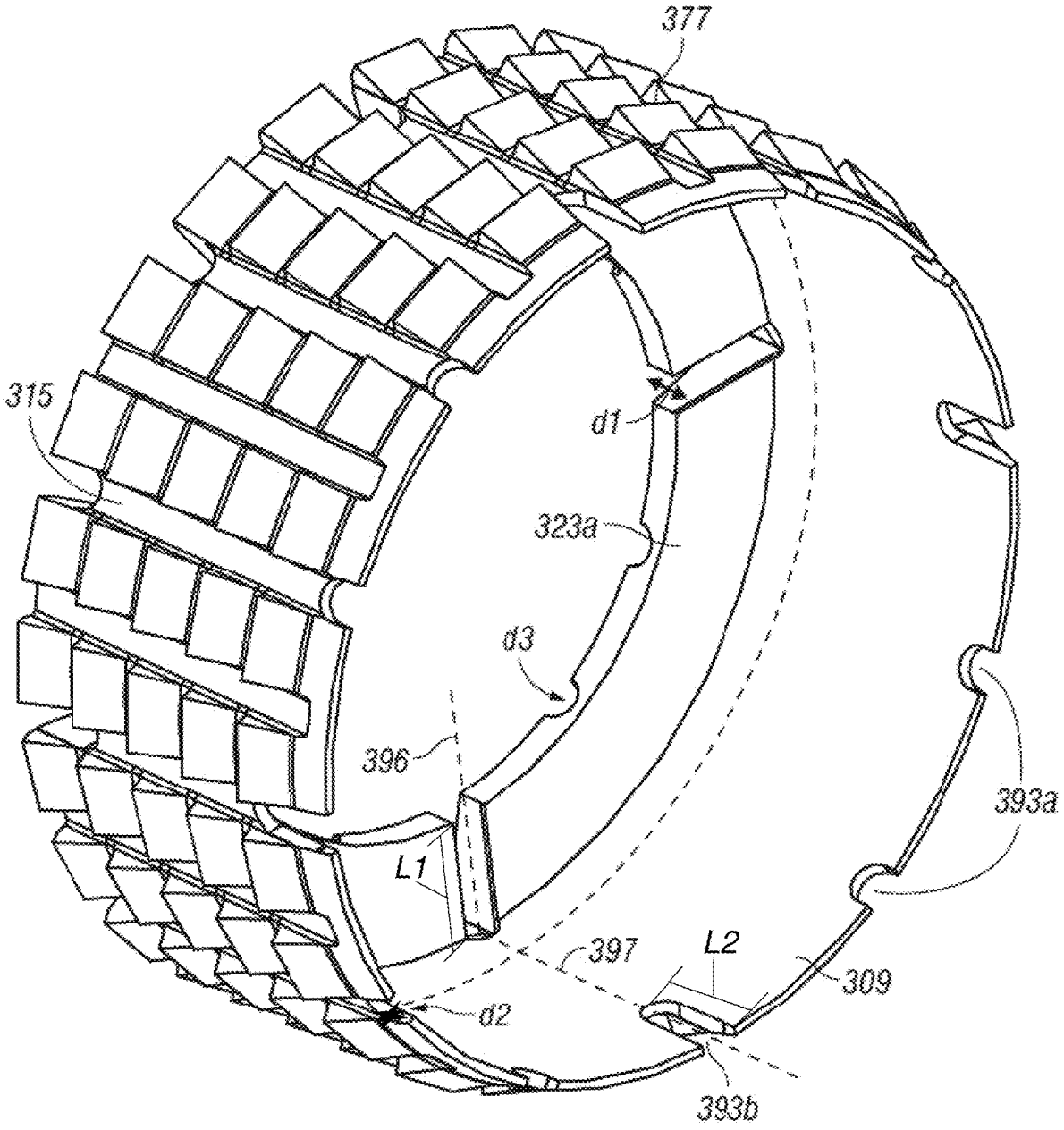
FIG. 3C shows an underside isometric view of a slip shell according to embodiments of the disclosure.
Figure 3D:
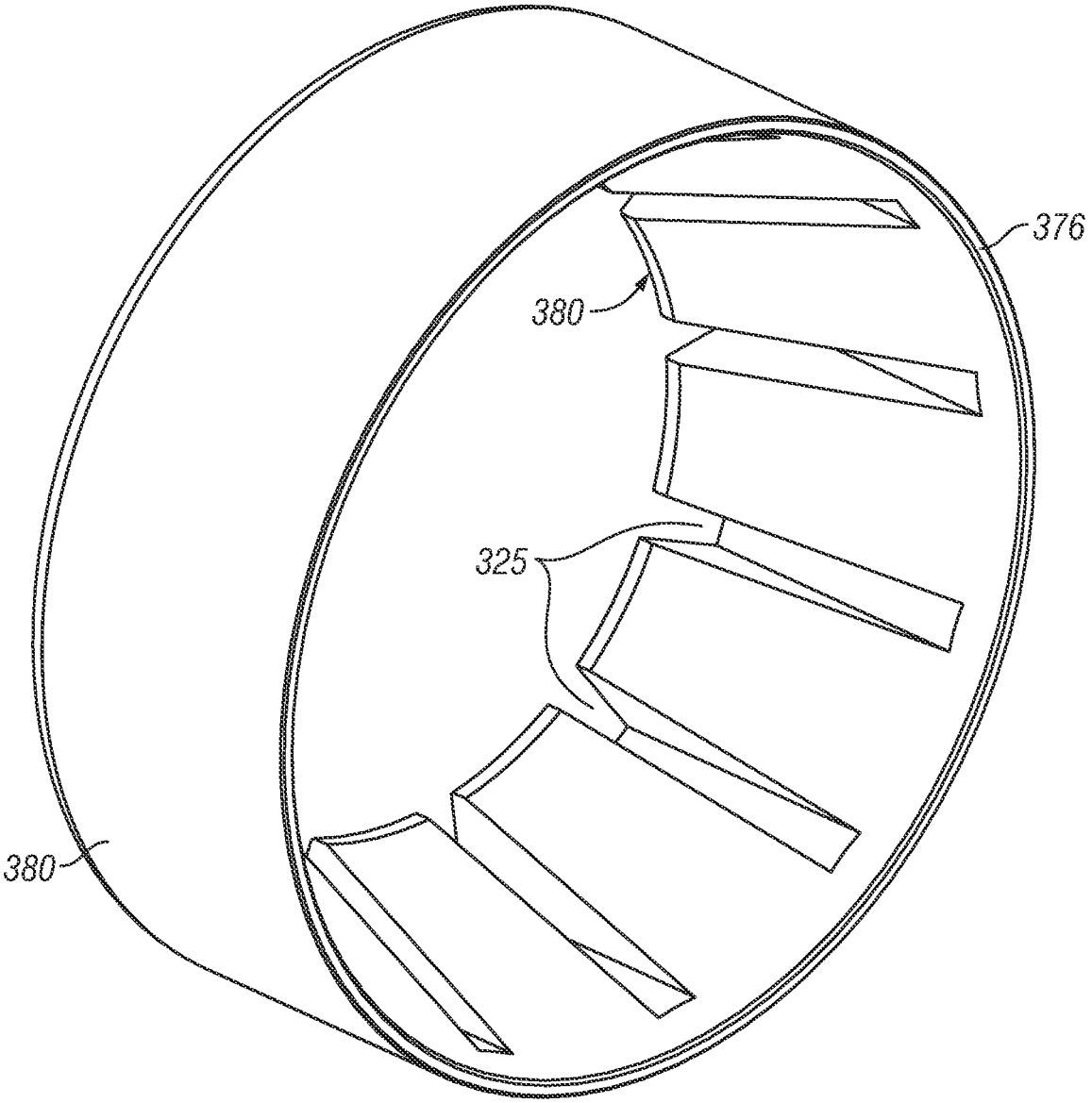
FIG. 3D shows an underside isometric view of a slip core according to embodiments of the disclosure.
Figure 3E:
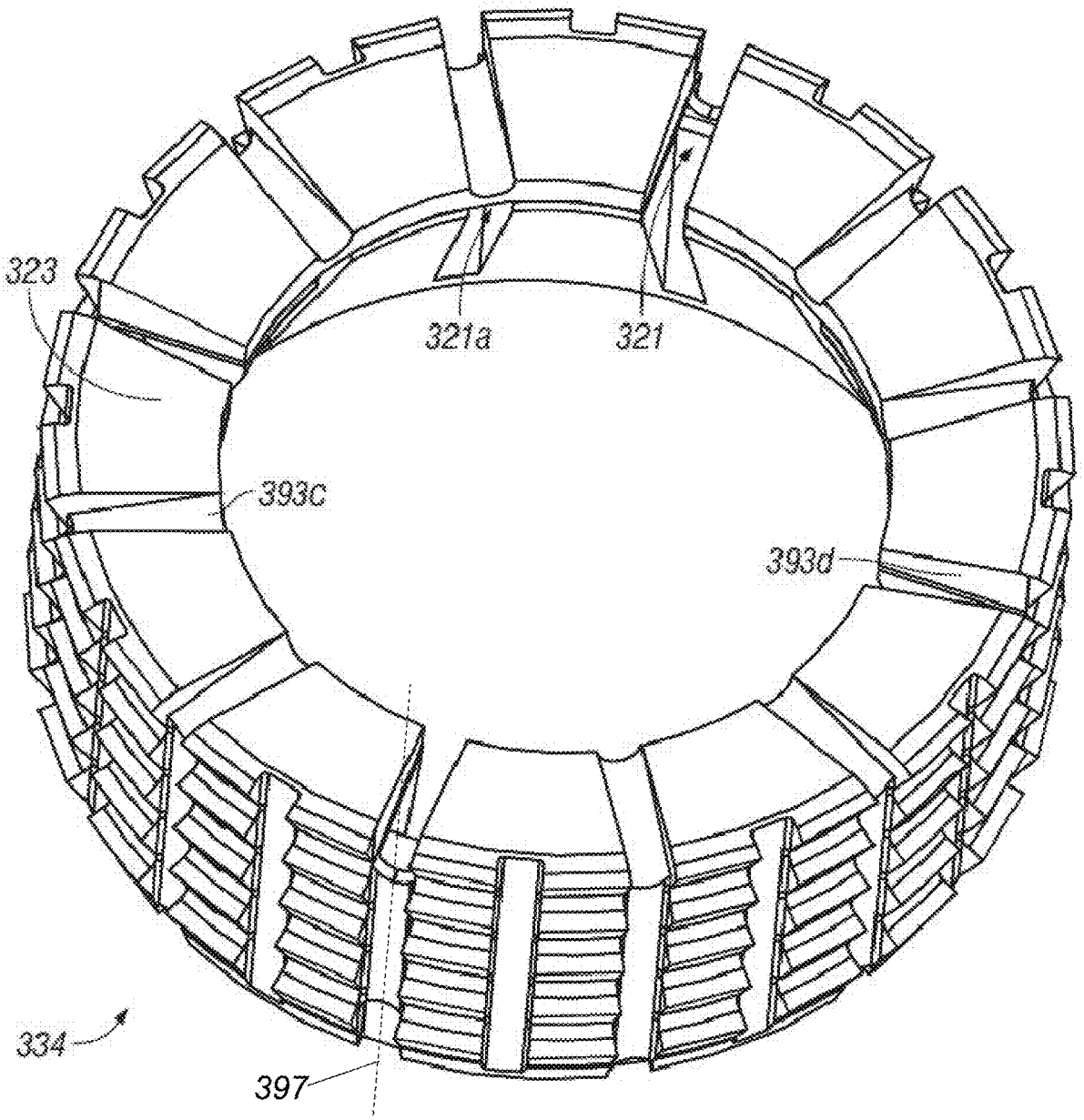
FIG. 3E shows a topside view of the hybrid slip according to embodiments of the disclosure.

In a similar manner, the core 376 may have the top surface 380*a* configured with one or more core openings or grooves 388. The grooves 393, 388 may be comparable or akin to break points of the slip 334. As shown in FIG. 3E, the grooves 393, 388 (or break points) may be kept in alignment when the shell 377 is engaged with the core 376. The aligned features may help or facilitate breaking. FIG. 3E further shows non-terminous alignment of the grooves at alignment point 321*a*, whereas other grooves may be coterminous to each other at alignment point 321. The core 376 may be one-piece in nature, configuration defined by at least partial connectivity of slip material around the entirety of its shell body, as shown via connectivity reference line 374*a*.

The use of a hybrid slip with a single- or one-piece slip configuration may reduce the chance of presetting that is associated with conventional slip rings, as conventional slips are known for pivoting and/or expanding during run in. As the chance for pre-set is reduced, faster run-in times are possible.

Advantages. Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

A synergistic effect is realized because a smaller tool means faster drilling time is easily achieved. Again, even a small savings in drill-through time per single tool results in an enormous savings on an annual basis.

Advantageously, the configuration of components, and the resilient barrier formed by way of the composite member results in a tool that can withstand significantly higher pressures. The ability to handle higher wellbore pressure results in operators being able to drill deeper and longer wellbores, as well as greater frac fluid pressure. The ability to have a longer wellbore and increased reservoir fracture results in significantly greater production.

As the tool may be smaller (shorter), the tool may navigate shorter radius bends in well tubulars without hanging up and presetting. Passage through shorter tool has lower hydraulic resistance and can therefore accommodate higher fluid flow rates at lower pressure drop. The tool may accommodate a larger pressure spike (ball spike) when the ball seats.

One piece slips assembly are resistant to preset due to axial and radial impact allowing for faster pump down speed. This further reduces the amount of time/water required to complete frac operations.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool comprising:

a mandrel comprising:

a mandrel body having a proximate end; a distal end; and an outer surface;

a hybrid slip disposed around the mandrel, the hybrid slip comprising:

a metal slip shell comprising:

a shell body;

an outer shell surface;

an inner shell surface;

a first groove defined by a depth extending from the outer shell surface through the inner shell surface, and having a length oriented in a lateral;

a second groove defined by a second depth from the outer shell surface but does not go all the way through to the inner shell surface;

a third groove having a third groove length oriented in a longitudinal;

a slip core disposed within the shell, the slip core comprising:

a slip core body;

an outer core surface engaged with the inner shell surface; and a core groove having an opening coterminous to the first groove;

wherein the slip core is made of a composite material, wherein the metal slip shell comprises a one-piece configuration defined by at least partial connectivity of slip material around an entirety of its shell body, and wherein the slip core also comprises a respective one-piece configuration defined by at least partial connectively of core material around a respective entirety of the slip core body.

2. The downhole tool of claim 1, the downhole tool further comprising:

a composite member disposed around the mandrel, the composite member further comprising:

a resilient portion; and a deformable portion.

3. The downhole tool of claim 1, wherein the slip core is epoxied to the slip shell.

4. The downhole tool of claim 3, wherein the mandrel comprises a flowbore, and an inner surface along the flowbore, and wherein a set of threads are formed on the inner surface.

5. The downhole tool of claim 1, the downhole tool further comprising:

a lower sleeve; and a sealing element, wherein the hybrid slip is void of a shear ring.

6. The downhole tool of claim 1, wherein the second groove is non-terminous aligned to another core groove of the slip core.

7. A downhole tool comprising:

a mandrel, the mandrel comprising:

a mandrel body having a proximate end; a distal end; and an outer surface;

a hybrid slip disposed around the mandrel, the hybrid slip comprising:

a metal slip shell comprising:

a shell body;

an outer shell surface;

an inner shell surface;

a first groove defined by a depth extending from the outer shell surface through the inner shell surface, and having a length oriented in a lateral;

a second groove defined by a second depth from the outer shell surface but does not go all the way through to the inner shell surface;

a third groove having a third groove length oriented in a longitudinal;

a slip core disposed within the metal slip shell, the slip core comprising:

a core body;

an outer core surface engaged with the inner shell surface; and a core groove having an opening coterminous to the first groove;

wherein the slip core is made of a composite material, wherein the metal slip shell comprises a one-piece configuration defined by at least partial connectivity of slip material around an entirety of its shell body, wherein the slip core also comprises a respective one-piece configuration defined by at least partial connectively of core material around a respective entirety of the slip core body, and wherein the hybrid slip is void of a shear ring.

8. The downhole tool of claim 7, wherein the slip core is adhered to the metal slip shell.

9. The downhole tool of claim 8, the downhole tool further comprising:

a composite member disposed around the mandrel, the composite member further comprising:

a resilient portion; and a deformable portion.

10. The downhole tool of claim 9, wherein the mandrel comprises a flowbore, and an inner surface along the flowbore, and wherein a set of threads are formed on the inner surface.

11. The downhole tool of claim 10, the downhole tool further comprising:

a lower sleeve; and a sealing element.

12. The downhole tool of claim 7, wherein the second groove is non-terminous aligned to another core groove of the slip core.

13. A hybrid slip for use with a downhole tool, the hybrid slip comprising:

a slip shell comprising:

a slip shell body;

an outer shell surface;

an inner shell surface;

a first groove defined by a depth extending from the outer shell surface through the inner shell surface, and having a length oriented in a lateral;

a second groove defined by a second depth from the outer shell surface but does not go all the way through to the inner shell surface;

a slip core disposed within the shell, the slip core comprising:

a core body;

an outer core surface engaged with the inner shell surface; and a core groove having an opening coterminous to the first groove;

wherein the slip shell comprises a one-piece configuration defined by at least partial connectivity of slip material around an entirety of the slip shell body, wherein the slip core also comprises a respective one-piece configuration defined by at least partial connectively of core material around a respective entirety of the slip core body, and wherein the hybrid slip is void of a shear ring.

14. The hybrid slip of claim 13, wherein the slip core is made of a composite material.

15. The hybrid slip of claim 14, wherein the slip shell is made of a metal material.

16. The hybrid slip of claim 15, wherein the slip shell and the slip core are adhered together.

17. The downhole tool of claim 13, wherein the second groove is non-terminous aligned to another core groove of the slip core.

* * * * *